US009961739B2

(12) United States Patent
Sedzin et al.

(10) Patent No.: US 9,961,739 B2
(45) Date of Patent: May 1, 2018

(54) CONTROLLER FOR A LAMP

(71) Applicant: NXP B.V., Eindhoven (NL)

(72) Inventors: Aliaksei Vladimirovich Sedzin, Eindhoven (NL); Marc Vlemmings, Helmond (NL)

(73) Assignee: NXP B.V., Eindhoven (NL)

( * ) Notice: Subject to any disclaimer, the term of this patent is extended or adjusted under 35 U.S.C. 154(b) by 0 days. days.

(21) Appl. No.: 15/426,174

(22) Filed: Feb. 7, 2017

(65) Prior Publication Data

US 2017/0238391 A1 Aug. 17, 2017

(30) Foreign Application Priority Data

Feb. 8, 2016 (EP) ..... 16154731

(51) Int. Cl.
*H05B 37/02* (2006.01)
*H05B 33/08* (2006.01)

(52) U.S. Cl.
CPC ..... *H05B 33/0863* (2013.01); *H05B 33/086* (2013.01); *H05B 33/0845* (2013.01); *H05B 33/0866* (2013.01)

(58) Field of Classification Search
CPC ..... H05B 33/0845; H05B 33/0854; H05B 33/0863; H05B 33/0872; H05B 37/0245; H05B 37/0254
USPC ..... 315/307, 309, 312
See application file for complete search history.

(56) References Cited

U.S. PATENT DOCUMENTS 7,213,940 B1 5/2007 Van De Ven et al.
8,159,150 B2 * 4/2012 Ashdown ..... H05B 33/0818 315/149
2006/0109389 A1 * 5/2006 Ichikawa ..... G09G 3/342 349/1

(Continued)

FOREIGN PATENT DOCUMENTS

EP 2 073 606 A2 5/2011
EP 2 073 606 A3 5/2011

(Continued)

*Primary Examiner* — Tung X Le

(57) ABSTRACT

A controller for a lamp, comprising an input terminal for receiving a requested-color-signal representative of a requested-color-value to be provided by the lamp and one or more temperature-values associated with the lamp. The controller includes a full-color-module for providing a full-color-lamp-control-signal for an output terminal; a stabilization-module for providing a stabilized-lamp-control-signal for the output terminal; and a mode controller for comparing the requested-color-value with a threshold value. If the requested-color-value satisfies the threshold value, then the stabilization-module provides the stabilized-lamp-control-signal to the output terminal. If the requested-color-value does not satisfy the threshold value, then the full-color-module provides the full-color-lamp-control-signal to the output terminal. The stabilization-module is configured to: generate stabilized-color-values based on the temperature-values; and provide the stabilized-lamp-control-signal based on the requested-color-value and the stabilized-color-values. The full-color-module is configured to provide the full-color-lamp-control-signal based on the requested-color-value.

15 Claims, 5 Drawing Sheets

(56) References Cited

U.S. PATENT DOCUMENTS

| | | | | |
|---|---|---|---|---|
| 2006/0221047 | A1* | 10/2006 | Tanizoe | G09G 3/3406 345/102 |
| 2010/0246197 | A1* | 9/2010 | Takahashi | F21S 6/004 362/430 |
| 2012/0080944 | A1* | 4/2012 | Recker | H02J 9/02 307/25 |
| 2012/0112662 | A1* | 5/2012 | Hatley | H05B 33/0863 315/294 |
| 2015/0022110 | A1* | 1/2015 | Sisto | H05B 33/086 315/210 |
| 2015/0115811 | A1* | 4/2015 | Bradford | H05B 33/0848 315/186 |

FOREIGN PATENT DOCUMENTS

| | | | |
|---|---|---|---|
| EP | 3 065 508 | A1 | 9/2016 |
| WO | WO-2013/179215 | A2 | 12/2013 |
| WO | WO-2013/179215 | A3 | 12/2013 |
| WO | WO-2014/068440 | A1 | 5/2014 |

* cited by examiner

CONTROLLER FOR A LAMP

CROSS-REFERENCE TO RELATED APPLICATIONS

This application claims the priority under 35 U.S.C. § 119 of European patent application no. 16154731.0, filed Feb. 8, 2016 the contents of which are incorporated by reference herein.

The present disclosure relates to controllers for lamps, and methods of controlling lamps, including colour controllable lamps such as RGB lamps.

According to a first aspect of the present disclosure there is provided a controller for a lamp, comprising:

an input terminal configured to receive:

a requested-colour-signal representative of a requested-colour-value to be provided by the lamp; and one or more temperature-values associated with the lamp;

an output terminal configured to provide a lamp-control-signal to the lamp;

a full-colour-module configured to provide a full-colour-lamp-control-signal for the output terminal;

a stabilization-module configured to provide a stabilized-lamp-control-signal for the output terminal; and a mode controller configured to compare the requested-colour-value with a threshold value, and:

if the requested-colour-value satisfies the threshold value, then instruct the stabilization-module to provide the stabilized-lamp-control-signal to the output terminal;

if the requested-colour-value does not satisfy the threshold value, then instruct the full-colour-module to provide the full-colour-lamp-control-signal to the output terminal;

wherein, the stabilization-module is configured to:

generate stabilized-colour-values based on the temperature-values; and provide the stabilized-lamp-control-signal based on the requested-colour-value and the stabilized-colour-values; and wherein, the full-colour-module is configured to:

provide the full-colour-lamp-control-signal based on the requested-colour-value.

Such a controller can advantageously enable a lamp to be used in two modes of operation: a stabilized-mode that can provide a stable/predictable colour when a requested colour is not highly saturated, which can take into account how the temperatures associated with the lamp can affect the colour of light provided by the lamp; and a full-colour-mode that can utilise the full colour that the lamp can provide when a requested colour is highly saturated.

In one or more embodiments the stabilized-lamp-control-signal represents an equally or less saturated colour than the full-colour-lamp-control-signal.

The stabilization-module may be configured to add one or more colour-correction-values to colour-values that define a full-colour-gamut in order to generate the stabilized-colour-values. The full-colour-lamp-control-signal may represent a colour-value in the full-colour-gamut. The stabilized-lamp-control-signal may represent a colour-value in a stabilized-colour-gamut, as defined by the stabilized-colour-values.

In one or more embodiments the controller is configured to receive information representative of a requestable-colour-gamut for the lamp. The threshold value may correspond to a boundary of the requestable-colour-gamut.

In one or more embodiments the lamp comprises first, second and third colour LEDs. The stabilized-colour-values may comprise RGB values. The stabilized-lamp-control-signal may be representative of a colour-value that is within a colour gamut defined by the stabilized-colour-values.

The stabilized-lamp-control-signal may represent a colour within a stabilized-colour-gamut of the lamp having stabilized-chromaticity-limits. The full-colour-lamp-control-signal may represent a colour within a full-colour-gamut of the lamp having full-colour-chromaticity-limits. The stabilized-colour-gamut may be a subset of the full-colour-gamut.

In one or more embodiments the lamp comprises first, second and third colour LEDs. The threshold value may represent a light output of the lamp provided in accordance with the stabilized-lamp-control-signal for which one of the LEDs has a light output below a LED-threshold-value.

In one or more embodiments the stabilization-module is further configured to:

generate the stabilized-colour-values based on the temperature-value, and a difference-value representative of the distance between (i) the requested-colour-value; and (ii) a boundary of a requestable-colour-gamut.

In one or more embodiments the stabilization-module is configured to set a degree of stabilization that is applied to the requested-colour-value based on the difference-value.

In one or more embodiments the controller is configured to linearly combine the full-colour-lamp-control-signal and the stabilized-lamp-control-signal in order to provide the lamp-control-signal.

In one or more embodiments the coefficients of the linear combination are functions of a difference-value representative of the distance between (i) the requested-colour-value; and (ii) a boundary of a requestable colour gamut.

In one or more embodiments the full-colour-module is configured to provide the full-colour-lamp-control-signal based on the temperature-values.

In one or more embodiments the threshold value is 1%, 2%, or 5% of a maximum colour value.

In one or more embodiments the lamp comprises a white LED.

There may be provided a method of controlling a lamp, the method comprising:

receiving a requested-colour-signal representative of a requested-colour-value to be provided by the lamp;

receiving one or more temperature-values associated with the lamp;

comparing the requested-colour-value with a threshold value;

if the requested-colour-value satisfies the threshold value, then:

generating stabilized-colour-values based on the temperature-values; and providing a stabilized-lamp-control-signal based on the requested-colour-value and the stabilized-colour-values if the requested-colour-value does not satisfy the threshold value, then:

providing a full-colour-lamp-control-signal based on the requested-colour-value; and providing a lamp-control-signal to the lamp based on the stabilized-lamp-control-signal or the full-colour-lamp-control-signal.

While the disclosure is amenable to various modifications and alternative forms, specifics thereof have been shown by way of example in the drawings and will be described in detail. It should be understood, however, that other embodiments, beyond the particular embodiments described, are possible as well. All modifications, equivalents, and alternative embodiments falling within the spirit and scope of the appended claims are covered as well.

The above discussion is not intended to represent every example embodiment or every implementation within the scope of the current or future Claim sets. The figures and Detailed Description that follow also exemplify various example embodiments. Various example embodiments may be more completely understood in consideration of the following Detailed Description in connection with the accompanying Drawings.

BRIEF DESCRIPTION OF DRAWINGS

One or more embodiments will now be described by way of example only with reference to the accompanying drawings in which.

DETAILED DESCRIPTION

Colour-controllable lamps typically include three light sources, respectively producing red (R), green (G) and blue (B) outputs. Sometimes more light sources are added to improve the lamp's performance at a specific colour, for example white (W) light source is added. By controlling the intensity of each of the light sources, a user may control both the perceived colour, or chromaticity, and the luminance, or intensity, of the lamp.

One or more examples disclosed herein relate to colour-changeable LED lamps. LED colour output may not be stable, and the human eye is sensitive to colour changes. Therefore there is a need for precise lamp output control. The knowledge of a junction temperature of the LEDs can allow for compensation for colour and intensity change. However, LED RGB(W) lamps that use output colour stabilization can have a limited colour gamut. Using primary LEDs instead of virtual colour corners as light sources for colour mixing, when a requested colour is close to the boundary of the stabilized colour gamut, can extend the colour gamut as and when it is beneficial to do so.

Figure 1:
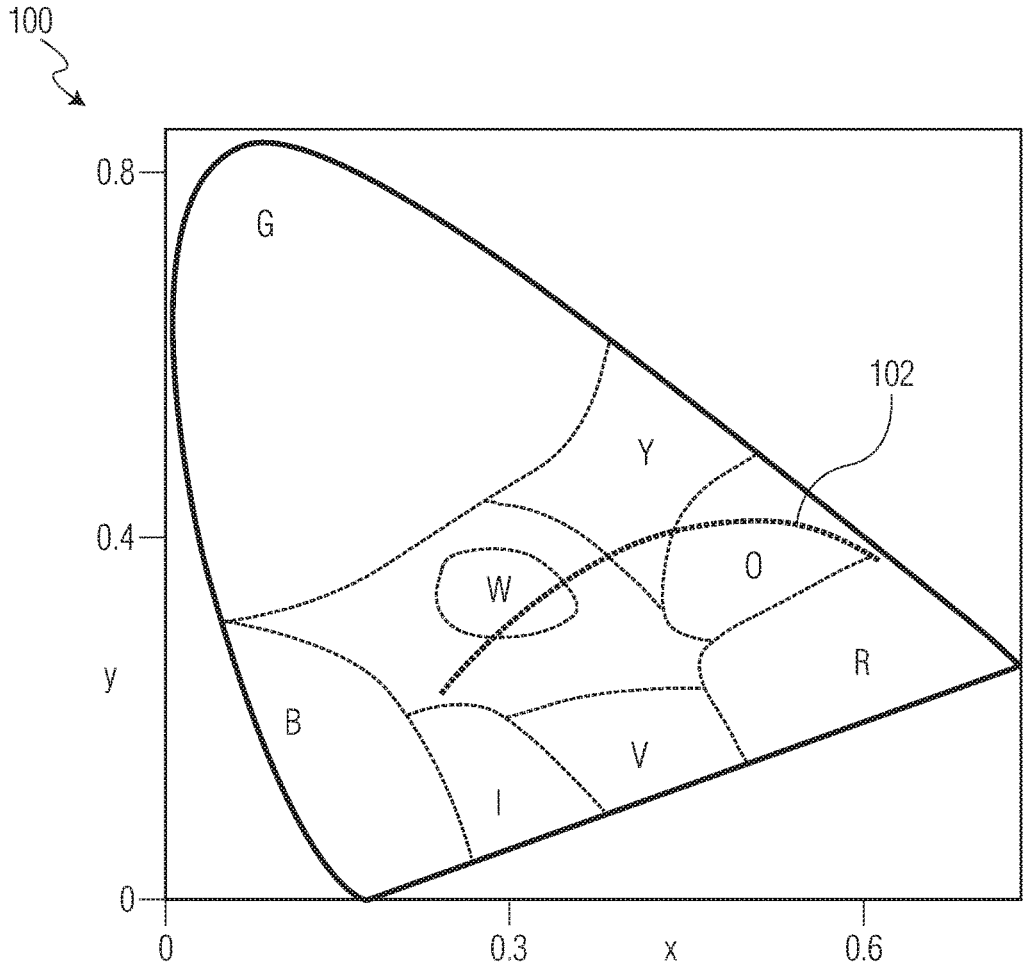
FIG. 1 shows a CIE 1931 chromaticity chart.

FIG. 1 shows a CIE 1931 chromaticity chart 100, in which a perceived colour, or chromaticity, is represented by two colour coordinates x and y, according to the CIE 1931 standard. Around the perimeter of the chart is shown the spectrum of colours ranging from red (R), through orange (O), yellow (Y), green (G), blue (B), indigo (I) and violet (V). The interior of the chart demonstrates various mixtures of the colours, with the central area corresponding to white light (W). Also shown on the figure is the black body radiation curve 102, corresponding to the colour of radiation emitted by a black body, which follows a path from the right to the left with increasing temperature.

It will be appreciated that a user has 3 degrees of freedom in controlling a RGB lamp—that is to say the magnitude of each of the red, green and blue channels. Two of these degrees of freedom control the chromaticity of the output, and the third degree controls the intensity. In the case of, for instance, 8-bit digital control where each of R, G and B can be assigned values between 0 and 255, and ignoring the variation of perceived intensity with colour, the sum R+G+B is indicative of the luminance, and the ratios B/R and G/R are indicative of chromaticity. Of course any other two pairs of ratios may be used; the third ratio will be determined from the two pairs of ratios and the sum.

In an ideal situation, the three light sources are "perfect" in the sense that they produce respectively monochromatic R, G and B light, which has a fixed chromaticity—that is to say it has fixed x and y, colour-coordinates, independent of operating conditions such as intensity or operating temperature.

Figure 2:
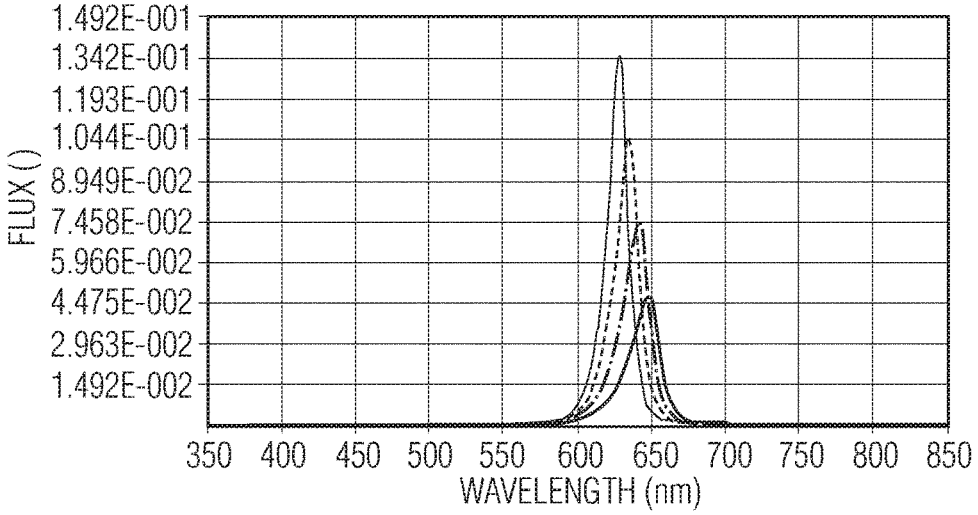
FIG. 2 is a plot that illustrates how, in practice, the light output of a red LED varies with temperature.

FIG. 2 is a plot that illustrates how, in practice, the light output of a red LED varies with temperature. Flux (light intensity) is shown on the vertical axis. Wavelength (chromaticity) is shown on the horizontal axis. Four separate plots are shown, each one representing the light output of the LED at different operating temperatures. FIG. 2 shows that, as the temperature is increased, the light intensity decreases and the wavelength spectrum of light increases. Also, of course, the LEDs will have tolerances such that different batches of components will produce light with different wavelengths and intensities. As will be discussed below, correction factors can be applied when controlling an RGB colour controllable LED lamp to account for these variations.

Figure 3:
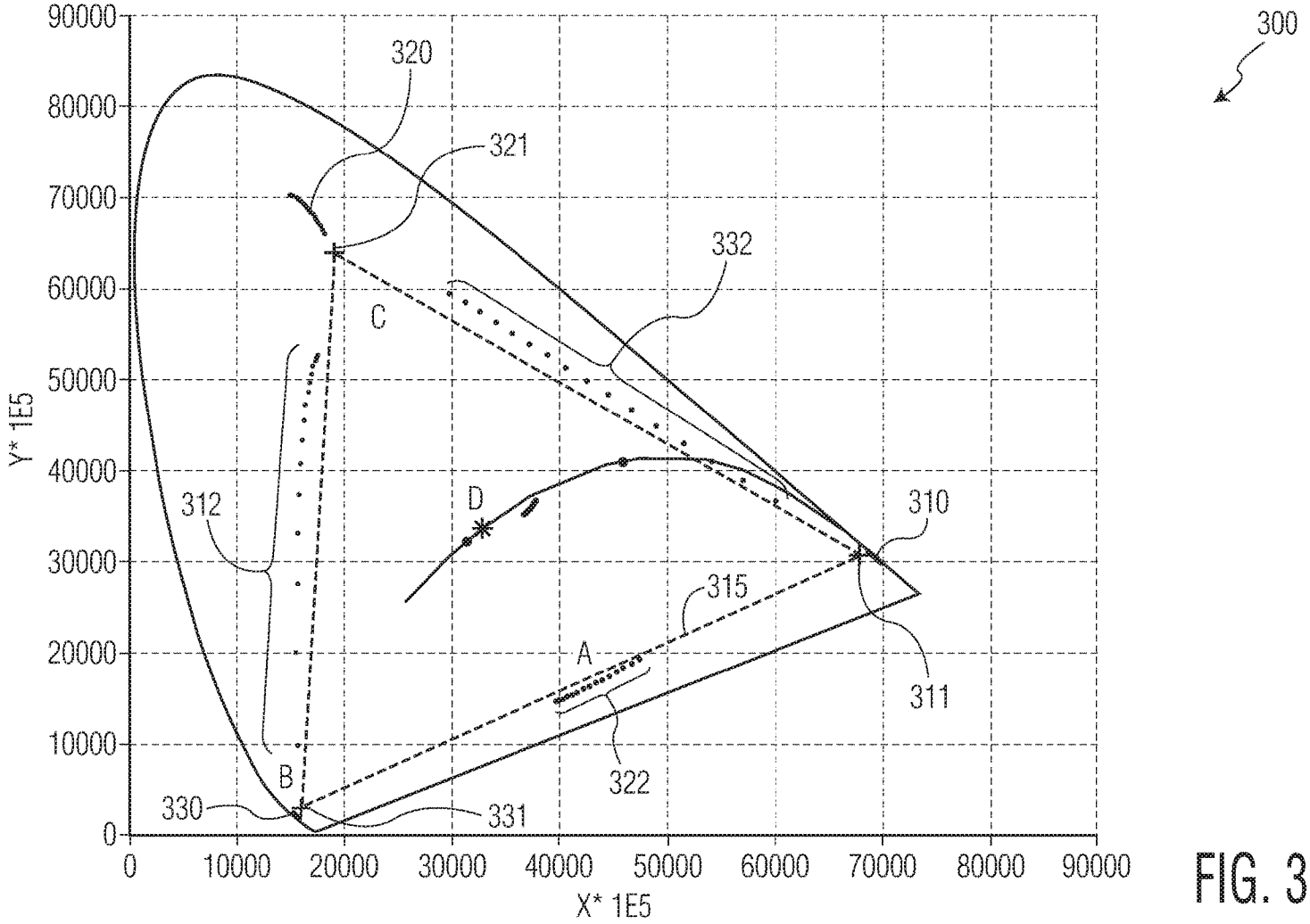
FIG. 3 shows another CIE 1931 chromaticity chart.

FIG. 3 shows a CIE 1931 chromaticity chart 300. The chart shows the variability of light output by the green LED as a sequence of discrete points that appear together as a green-variability-line 320, which represents the range of xy coordinates of the light output by a green LED under varying operating conditions (including varying temperature). Similarly, the chart shows the variability of light output chromaticity by the red LED as red-variability-line 310, and the variability of light output chromaticity by the blue LED as blue-variability-line 330. The variability of the red and blue LEDs light output chromaticity is not as severe as that of the green LED.

As is clear from the figure, the light output from each of the LEDs does not have a fixed chromaticity/colour, that is to say it is not represented by a single point on the chart. Rather, it varies with operating conditions, and in particular with the junction temperature of the LED. Moreover, and although this is not shown on the chart, the luminance—that is to say the intensity—of the light output from each LED also varies with its junction temperature.

Figure 4:
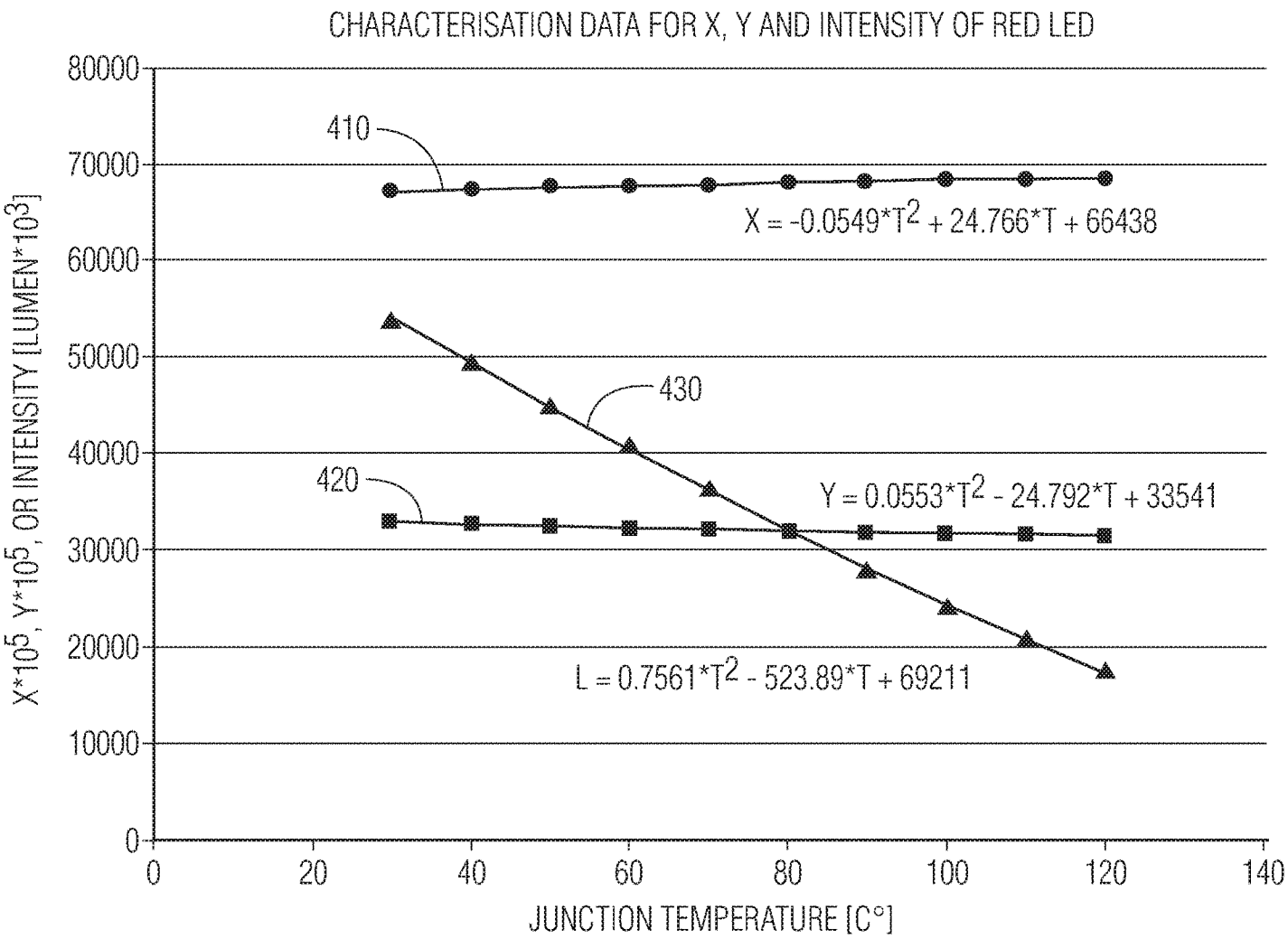
FIG. 4 shows the results of an experimental characterisation of a red LED.

FIG. 4 shows the results of an experimental characterisation of a red LED. The variation of the x-coordinate, y-coordinate and luminance of an LED with operating temperature that is illustrated in FIG. 3 can be measured. FIG. 4 shows luminance, x- or y-coordinate on the vertical axis and temperature on the horizontal axis. Variation of the x-coordinate value of the CIE 1931 chromaticity is shown with reference 410. Variation of the y-coordinate value of the CIE 1931 chromaticity is shown with reference 420. Variation of luminance is shown with reference 430. The variation may be approximated by fitting a second-order polynomial (quadratic) of the form $ax^2+bx+c$ to the experimental data. For relative LED shown in FIG. 3 the data may be fitted by:

$$x\text{-coordinate}(\times 10^5)=(-0.0586)\cdot T^2+(25.712)\cdot T+(66406), \quad (1)$$

$$y\text{-coordinate}(\times 10^5)=(0.0592)\cdot T^2+(25.753)\cdot T+(33574), \quad (2)$$

$$\text{and luminance}(\times 10^2)=(-08976)\cdot T^2+(-522.08)\cdot T+(65072). \quad (3)$$

These 9 fitting parameters thus define the operation of the red LED. So for three LEDs a total of 27 parameters are required. Use of these parameters can enable the xy coordinates and luminance of a RGB lamp to be determined at given temperature value.

Returning to FIG. 3, it will be appreciated that the chromaticity of light that can be output by the RGB lamp will be defined by a triangle with points at each of: (1) somewhere on the green-variability-line 320; (2) somewhere on the red-variability-line 310; and (3) somewhere on the blue-variability-line 330. This triangle may be referred to as a colour gamut. As discussed above, the range of chromaticity values that can be provided vary in accordance with operating conditions. Therefore, if a single algorithm were used to translate a required colour-value into a lamp-control-signal without taking into account operating conditions (especially temperature), then the algorithm would result in light output having an unstable/inconsistent chromaticity for the same required colour-value. Also shown in FIG. 3 are three "colour corners" 311, 321, 331 on the chromaticity chart. Each of these colour corners 311, 321, 331 represents an achievable chromaticity of light that may be achieved by the lamp, irrespective of the temperature of operation and an accepted degree of tolerance in manufacture. The colour of the "colour corners" 311, 321, 331 can be considered as less saturated than the colour of the corresponding LED variability lines 310, 320, 330 inasmuch as they represent colours that are less intense/deep than the maximum colour intensity that can be achieved by the LED. It will be appreciated that the mathematical relationship between the colour values of (i) the "colour corners" 311, 321, 331; and (ii) the LED variability lines 310, 320, 330 will depend upon how the colour values are represented—as non-limiting examples: RGB, x-y colour space, etc. If the colour values are RGB values (normalised so that the requested intensity of light does not affect the processing), then a more saturated colour can be considered as having one or more lower components of the RGB colour values. Irrespective of a colour space/model that is used, the skilled person will appreciate the relationship between more and less saturated colours in any specific colour space/model.

The triangle bounded by the three colour corners 311, 321, 331 represents a range of chromaticity values that should always be achievable by an RGB lamp, irrespective of operating conditions. This triangle will be referred to as a requestable-colour-gamut 315, and can be encoded onto a lamp, or otherwise associated with the lamp. The requestable-colour-gamut 315 represents a range of chromaticities that can be provided in a stable way, and can be used by a lamp controller to ensure that the lamp is not instructed to produce light that is outside of the requestable-colour-gamut 315 because such light would be unpredictable/unstable.

Such colour stabilization (for example using a fixed corners algorithm to define the three (fixed) colour corners 311, 321, 331) leads to a restricted/limited colour gamut of an RGB LED lamp. The restriction results from the fact that colour is stabilized for all possible primary LED colour variations. This prevents the lamp from rendering maximally saturated colours.

In one example, a required colour value is in an RGB format, and each of the individual RGB values can take a value between 0 and 255 (corresponding to eight bit digital control). Light with chromaticity at point A may be achieved by (255, 0, 255); chromaticity at point B by (0, 10, 255), and chromaticity at point C by (20, 255, 20) and chromaticity at point D by (255, 255, 255).

The chromaticity values of each of the actual LEDs at any given temperature may be determined using the quadratic fitting parameters described above. Then, provided that, for all temperatures, the chromaticity value of each of the actual LEDs is suitably positioned outside of the requestable-colour-gamut 315 formed by the colour corners, the chromaticity of the actual LEDs may be "corrected", so that they have the chromaticity of the colour corners 311, 321, 331 respectively, by adding a small amount of light from the other LEDs, to each LED. For the green LED, having a green-variability-line shown as 320, the red and blue LEDS can be operated such that together they output purple light with a specific chromaticity that brings the actual light output by the green LED down to the green colour corner 321. The variability of purple light required to achieve this is shown as a plurality of discrete values in FIG. 3 that is illustrated as a green-correction-variability-line 322. Similarly, a blue-correction-variability-line 332 identifies a range of yellow light chromaticties required to bring the actual light output by the blue LED down to the blue colour corner 331, and a red-correction-variability-line 312 identifies a range of cyan light chromaticties required to bring the actual light output by the red LED down to the red colour corner 311.

By reducing the chromaticity of each LED down to an associated colour corner 311, 321, 331 before subsequent colour mixing, a consistent and stable light output can be provided by the lamp for a given required colour value, irrespective of where on the variability curves 310, 320, 330 an LED happens to be operating. By using a temperature-value associated with the LEDs, software can determine the degree to which the chromaticity of each LED exceeds its associated colour corner 311, 321, 331, and therefore how the other 2 LEDs should be operated to bring the chromaticity of the lamp down to the associated colour corner 311, 321, 331.

In this way, a controller can generate stabilized-colour-values (illustrated as the colour corners 311, 321, 331 in FIG. 3) based on one or more temperature-values associated with the lamp. This can involve determining one or more colour-correction-values to add to each operating point on the variability-lines 310, 320, 330 (which together define a full-colour-gamut), in order to bring the overall chromaticity of lamp down to the requestable-colour-gamut 315 as defined by the colour corners 311, 321, 331. The colour-correction-values are based on the temperature-values of the lamp. The one or more colour-correction-values can be based on specific values from one or more of the green-variability-line 320, blue-variability-line 330 and the red-variability-line 310, depending upon the temperatures of operation.

The controller can then generate a stabilized-lamp-control-signal based on the requested-colour-value and the colour corners 311, 321, 331 (stabilized-colour-values). The stabilized-lamp-control-signal can have a component for each of the individual LEDs. For example, the controller can perform respective linear combinations of each component of the requested-colour-value and the associated components of each of the colour corners 311, 321, 331 in order to determine the stabilized-lamp-control-signal. This signal is an instruction signal for the lamp (which may simply have suitable current levels for driving the LEDs in the lamp) that will cause the lamp to provide a predictable/stable light output, irrespective of the temperature of operation.

A numerical example, using RGB colour values is as follows:

A requested-colour-value is (255, 255, 0), which represents yellow light.

For a given temperature, the stabilized-colour-values (colour corners 311, 321, 331) have been determined as:

Red: (255, 2, 1), which may be referred to as a red-stabilized-colour-value;

Green: (2, 255, 1), which may be referred to as a green-stabilized-colour-value;

Blue: (1, 2, 255), which may be referred to as a blue-stabilized-colour-value;

The stabilized-colour-values are then mixed (optionally proportionally) in accordance with the requested-colour-value. For the red LED of the lamp, the red component of each stabilized-colour-value is mixed with the corresponding colour component of the requested-colour-value, and the results of each mix are combined. By "corresponding", it is meant the colour component of the requested-colour-value that corresponds to the stabilized-colour-value (colour corner) in question. As illustrated below, (a), (b) and (c) are calculated and then added together to give (d), which is representative of the red component of the stabilized-lamp-control-signal:

(a): (red component of red-stabilized-colour-value)×(red component of the requested-colour-value)=255×255=65,025

(b): (red component of green-stabilized-colour-value)×(green component of the requested-colour-value)=2×255=510

(c): (red component of blue-stabilized-colour-value)×(blue component of the requested-colour-value)=1×0=0

(d): (a)+(b)+(c)=65535.

Similarly, for the green LED:

(e): (green component of red-stabilized-colour-value)×(red component of the requested-colour-value)=2×255=510

(f): (green component of green-stabilized-colour-value)×(green component of the requested-colour-value)=255×255=65,025

(g): (green component of blue-stabilized-colour-value)×(blue component of the requested-colour-value)=2×0=0

(h): (d)+(e)+(f)=65535

Similarly, for the blue LED:

(i): (blue component of red-stabilized-colour-value)×(red component of the requested-colour-value)=1×255=255

(j): (blue component of green-stabilized-colour-value)×(green component of the requested-colour-value)=1×255=255

(k): (blue component of blue-stabilized-colour-value)×(blue component of the requested-colour-value)=255×0=0

(l): (d)+(e)+(f)=510.

Then, the stabilized-lamp-control-signal can be provided that has a red component that is based on 65535 a green component that is based on 65535 and a blue component that is based on 510. These values can be normalised to 255 by dividing by 257 and rounding to integers, such that the stabilized-lamp-control-signal is representative of an RGB value of (255, 255 2). In some examples, each component can be proportional to its associated numerical value. In some examples, additional processing may be performed on the stabilized-lamp-control-signal, for example to account for variations in light intensity with temperature, before generating a final lamp-control-signal that is received by the lamp.

The temperature correction for each of the LEDs (in order to determine the stabilized-colour-values) may be carried out using a lookup table. However, for implementations that use 12 bit control (for example), the lookup table may become very large. In one or more embodiments, even though not required for practicing the embodiments described herein, a microcontroller IC, such as the JN5168, and JN5169 microcontroller available from NXP semiconductors, may be used. The LED driver control may then be performed via four channel PWM output from the microcontroller. Calculations associated with the method can then for example be provided in the form of a precompiled library.

Operating in this way, by generating stabilized-colour-values based on temperature-values, and then using the stabilized-colour-values and a requested-colour-value to generate a stabilized-lamp-control-signal can be considered as operating in a stabilized-mode-of-operation. It is stable inasmuch as the actual colour/chromaticity of light output by the lamp is stable/consistent irrespective of the temperature of the lamp.

Figure 5:
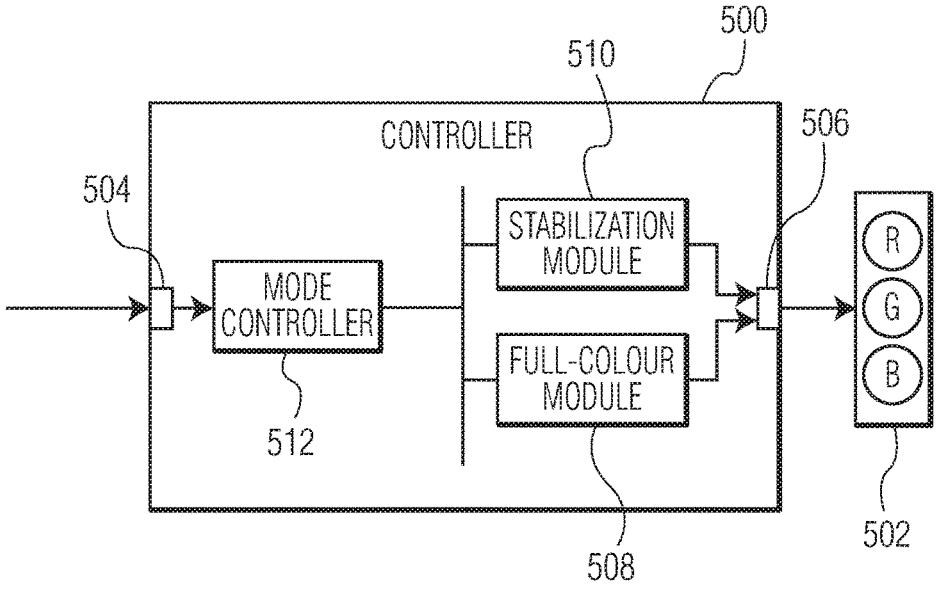
FIG. 5 illustrates schematically an example embodiment of a controller for a lamp.

FIG. 5 illustrates schematically an example embodiment of a controller 500 for a lamp 502. In this example, the lamp 502 is an RGB lamp that includes a red LED, a green LED and a blue LED. The controller 500 has an input terminal 504 that receives: (i) a requested-colour-signal representative of a requested-colour-value to be provided by the lamp 502; and temperature-values associated with the lamp 502. The requested-colour-value may be in any format, including for example an RGB value, an xy value, etc.

It will be appreciated that the input terminal 502 may or may not be an external terminal of the controller 500. For example, in some examples, the controller may determine the temperature-values of the lamp 502 internally, based on, for example, measured values of currents flowing through the LEDs in the lamp.

The controller 500 also includes an output terminal 506 that provides a lamp-control-signal to the lamp 502.

The controller 500 includes a full-colour-module 508 that provides a full-colour-lamp-control-signal for the output terminal 506 when the controller 500 is operating in a full-colour-mode-of-operation. The controller 500 includes a stabilization-module 510 that provides a stabilized-lamp-control-signal for the output terminal 506 when the controller 500 is operating in a stabilized-mode-of-operation.

A mode controller 512 compares the requested-colour-value with a threshold value in order to determine whether the controller 500 should operate in the full-colour-mode-of-operation or the stabilized-mode-of-operation. That is, if the colour-value satisfies the threshold value, then the mode controller 512 instructs the stabilization-module 510 to provide the stabilized-lamp-control-signal to the output terminal 506. If the colour-value does not satisfy the threshold value, then the mode controller 512 instructs the full-colour-module 508 to provide the full-colour-lamp-control-signal to the output terminal 506.

The threshold value is used to determine how close the requested-colour-value is to the chromaticity limits as defined by requestable-colour-gamut shown in FIG. 3. As will be discussed below, the controller 500 can operate in the stabilized-mode-of-operation if the requested-colour-value is sufficiently far away from the chromaticity limits of the requestable-colour-gamut. Similarly, the controller 500 can operate in the full-colour-mode-of-operation if the requested-colour-value is sufficiently close to the chromaticity limits as defined by requestable-colour-gamut, in which case, the lamp 502 is operated at its maximum chromaticity potential, in preference to providing a stabilised colour for all operating conditions of the lamp.

The stabilization-module 510 generates stabilized-colour-values based on the received temperature-values, and then uses the stabilized-colour-values and the requested-colour-value to generate the stabilized-lamp-control-signal. As discussed above with reference to FIG. 3, this can involve translating the requested colour-value to a position in the requestable-colour-gamut in order to bring the overall chromaticity of the lamp down to the colour corners. In this way, a stabilised/consistent light output can be provided by the lamp 502 irrespective of the operating temperatures of the LEDs in the lamp 502.

The full-colour-module 508, in contrast, provides the full-colour-lamp-control-signal based directly on the requested-colour-value. That is, the requested-colour-value is not corrected/modified to provide a stabilised/consistent light output. In this way, a maximum achievable saturation (depth of colour) can be achieved for each and every lamp 502 when operating in this mode of operation, albeit the achieved chromaticity for a given colour-value may vary depending upon the operating temperature of the LEDs in the lamp 502.

As an example, in the full-colour-mode-of-operation, if pure red light is requested, then the full-colour-lamp-control-signal will be representative of an RGB value of (255, 0, 0). In contrast, if pure red light were requested when the controller 500 is operating in the stabilized-mode-of-operation, the stabilized-lamp-control-signal will be representative of an RGB value of (255, x, y), where x and y do not equal zero. The exact values of x and y will be set by the controller 500 in accordance with the received temperature-value, in order to bring the chromaticity of the light output by the lamp 502 down to the colour corner that is shown in FIG. 3. In the above numerical example the, stabilized-lamp-control-signal would be representative of (255, 2, 1) (following normalisation by dividing by 255).

It will be appreciated that the above discussion of chromaticity values does not take into account a required brightness/luminance of a lamp, which can be processed separately. The above discussion of comparing colour-values with threshold values can be considered as operating on normalised colour-values, and that a required brightness can be taken into account by subsequent processing of the full-colour-lamp-control-signal or stabilized-lamp-control-signal.

Figure 6:
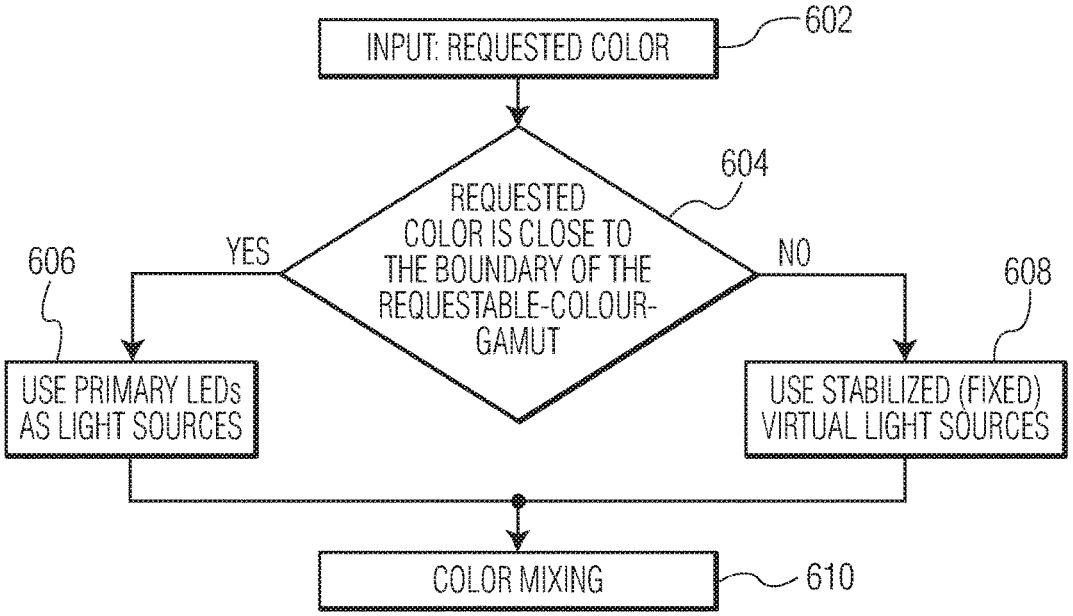
FIG. 6 shows schematically an example embodiment of a process flow for controlling a lamp.

FIG. 6 shows schematically an example embodiment of a method for controlling a lamp.

At step 602, the method receives a requested-colour-value as an input. At step 604, the method determines whether or not the requested colour is close to the boundary of a requestable-colour-gamut, as shown in FIG. 3. The requestable-colour-gamut can define a range of colours that may be reliably delivered by the lamp irrespective of operating temperature and tolerances in the manufacture of the lamp.

If the requested colour is close to the boundary, then at step 606 the method uses primary LEDs as light sources. This can be implemented by part of the full-colour-module of FIG. 5, for example. If the requested colour is not close to the boundary, then at step 608 the method uses stabilized (fixed) virtual light sources. This can be implemented by part of the stabilization-module of FIG. 5, for example. At step 610, using either (i) the primary LEDs from step 606 (that is, no stabilization is performed to generate stabilized-colour-values/colour corners); or (ii) stabilized-colour-values (based on the temperature of the lamp) from step 608, the necessary colour mixing is performed to cause the lamp to output light with the desired chromaticity. Colour mixing can be performed using a known centre of gravity method, for example.

In this way, when the requested colour lies close to the boundary of the requestable-colour-gamut, a more saturated colour is rendered. It is more saturated because the colour gamut is extended by substituting the (stabilized) colour corners with (non-stabilized) primaries for a subsequent colour mixing algorithm. This can enable colour stabilization to be preserved for the non-saturated colours (which can include points on the black body curve); and at the same time enable a colour of maximum possible saturation to be rendered when saturated colours are requested. Therefore, colour stabilization is not entirely sacrificed because the non-stabilized primaries are only used in the subsequent colour mixing algorithm when the requested colour is close to the boundary of the requestable-colour-gamut.

Determining whether or not the requested colour is close to the boundary of a requestable-colour-gamut at step 604 can be implemented by comparing the requested colour-value with a threshold value. For example, for an RGB requested colour-value, by checking the following condition:

$R \leq a$ or $G \leq a$ or $B \leq a$, where R, G and B are the requested colour controls and a is the threshold value.

The threshold value a can be zero in one example, in which case the requested-colour value is only considered close to the boundary if it is on the boundary. That is, the boundary of the triangle can be defined as colour values at which one or two of the RGB values are zero.

Alternatively, the threshold value a may be non-zero, in which case a full-colour-region is defined around the periphery of the colour gamut triangle. The thickness of the full-colour-region is defined by the threshold value a. When the requested colour-value falls within the full-colour-region, the method moves on to step 606 instead of step 608. The threshold value a may be 1%, 2%, or 5% of a maximum colour value (such as a RGB value), for example.

In some examples, if the requested colour-value falls within the full-colour-region, the method can generate the stabilized-colour-values (fixed colour corners) at step 608 based on the temperature-value (as discussed above), and also a difference-value representative of the distance between (i) the requested-colour-value; and (ii) the boundary of the requestable-colour gamut. For example, the method can apply an algorithm that effectively sets a degree of stabilization that will be applied based on how close the requested colour value is to the boundary of the colour gamut triangle. In one instance, this can involve applying a weighting to the colour-correction-values that are added to the full-colour-gamut to provide the stabilized-colour-values. For example, 100% of the colour-correction-values are added for a maximum-difference value, and 0% of the colour-correction-values are added for a minimum-difference value. In this way a degree of stabilization can be set.

In a further still example, the method can compare the requested colour-value to a plurality of threshold values. Then, depending upon which threshold values are satisfied, the method can apply one or a plurality of different stabilization-modes-of-operation, for example to set a degree of stabilization that will be applied.

In an alternative example, the requested colour-value can be represented by xy coordinates. In such an example, a distance between the requested colour and the requestable-colour-gamut can be determined. If the distance is below a threshold value then the xy coordinates can be mapped to an extended colour gamut at step 606, for example by using a full-colour module as discussed above.

It will be appreciated that a similar approach can be taken for any other colour domain that may be used.

In some examples, the controller can linearly combine a full-colour-lamp-control-signal and a stabilized-lamp-control-signal in order to provide the lamp-control-signal. This can enable the controller to gradually blend in between a stabilized-mode-of-operation and a full-colour-mode-of-operation. The coefficients of the linear combination can be functions of a difference-value representative of the distance between (i) the requested-colour-value; and (ii) the boundary of the requestable colour gamut.

Figure 7:
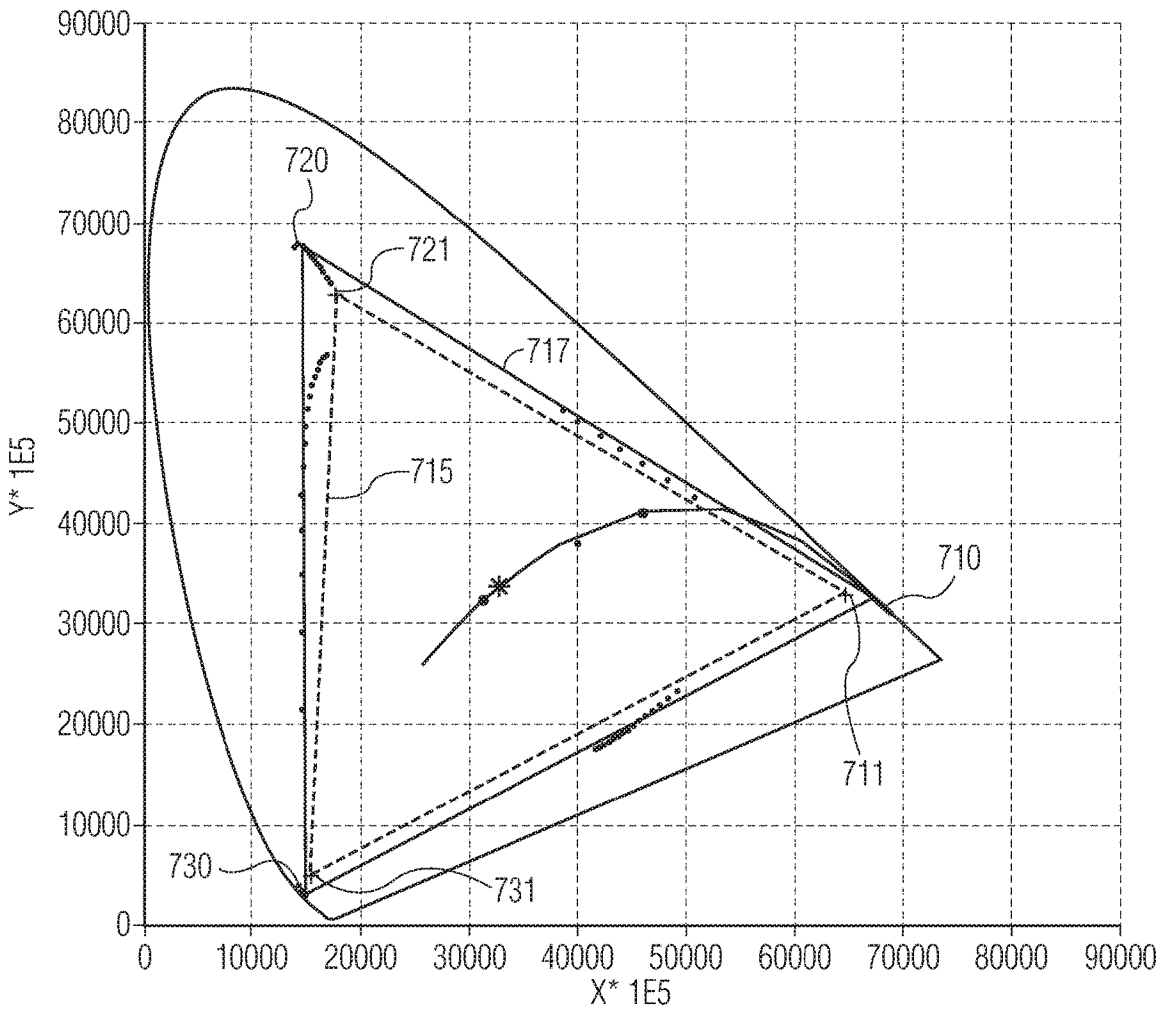
FIG. 7 shows a further still CIE 1931 chromaticity chart.

FIG. 7 shows another CIE 1931 chromaticity chart 700. Features of FIG. 7 that are similar to those of FIG. 3 have been given corresponding numbers in the 700 series, and will not necessarily be described again here.

A requestable-colour-gamut (stabilized colour gamut) 715 is shown in FIG. 7, bounded by three colour corners 711, 721, 731. A full-colour-gamut 717 (extended colour gamut) is also shown in FIG. 7. The full-colour-gamut 717 is bounded by points on the green-variability-line 720, red-variability-line 710 and blue-variability-line 730. The specific points on these variability lines will depend upon the operating temperatures of the LEDs, as discussed above.

The requestable-colour-gamut 715 represents a stabilized-colour-gamut of the lamp having stabilized-chromaticity-limits that correspond to the controller operating in a stabilized-mode-of-operation. When a controller is operating a lamp in a stabilized-mode-of-operation, it determines where on the variability-lines 710, 720 730 each lamp should be operating, based on their temperature values, and then determines colour-correction-values for adding to the full-colour-gamut 717 in order to bring the overall chromaticity of the lamp down to the requestable-colour-gamut 715 as defined by the colour corners 711, 721, 731.

The full-colour-gamut 717 represents a colour-gamut of the lamp having full-colour-chromaticity-limits that correspond to the controller operating in a full-colour-mode-of-operation. FIG. 7 clearly shows that the chromaticity limits of the requestable-colour-gamut 715 are less than those of the full-colour-gamut 717. That is, the requestable-colour-gamut 715 is enclosed by the full-colour-gamut triangle 717 such that the stabilized-colour-gamut 715 is a subset of the full-colour-gamut 717. In this way, the full-colour-gamut 717 allows colours to be produced that are more saturated (deep or pure) with respect to the requestable-colour-gamut 715. In other words pure colours can be produced using the full-colour-gamut 717. Those colours are less diluted by other colours than would be the case for stabilized colours.

FIG. 7 graphically illustrates how the full-colour-gamut 717 (extended colour gamut) can be used to achieve maximum possible saturation, while preserving colour stabilization for non-saturated colours using the requestable-colour-gamut 715.

The instructions and/or flowchart steps in the above figures can be executed in any order, unless a specific order is explicitly stated. Also, those skilled in the art will recognize that while one example set of instructions/method has been discussed, the material in this specification can be combined in a variety of ways to yield other examples as well, and are to be understood within a context provided by this detailed description.

In some example embodiments the set of instructions/method steps described above are implemented as functional and software instructions embodied as a set of executable instructions which are effected on a computer or machine which is programmed with and controlled by said executable instructions. Such instructions are loaded for execution on a processor (such as one or more CPUs). The term processor includes microprocessors, microcontrollers, processor modules or subsystems (including one or more microprocessors or microcontrollers), or other control or computing devices. A processor can refer to a single component or to plural components.

In other examples, the set of instructions/methods illustrated herein and data and instructions associated therewith are stored in respective storage devices, which are implemented as one or more non-transient machine or computer-readable or computer-usable storage media or mediums. Such computer-readable or computer usable storage medium or media is (are) considered to be part of an article (or article of manufacture). An article or article of manufacture can refer to any manufactured single component or multiple components. The non-transient machine or computer usable media or mediums as defined herein excludes signals, but such media or mediums may be capable of receiving and processing information from signals and/or other transient mediums.

Example embodiments of the material discussed in this specification can be implemented in whole or in part through network, computer, or data based devices and/or services. These may include cloud, internet, intranet, mobile, desktop, processor, look-up table, microcontroller, consumer equipment, infrastructure, or other enabling devices and services. As may be used herein and in the claims, the following non-exclusive definitions are provided.

In one example, one or more instructions or steps discussed herein are automated. The terms automated or automatically (and like variations thereof) mean controlled operation of an apparatus, system, and/or process using computers and/or mechanical/electrical devices without the necessity of human intervention, observation, effort and/or decision.

It will be appreciated that any components said to be coupled may be coupled or connected either directly or indirectly. In the case of indirect coupling, additional components may be located between the two components that are said to be coupled.

In this specification, example embodiments have been presented in terms of a selected set of details. However, a person of ordinary skill in the art would understand that many other example embodiments may be practiced which include a different selected set of these details. It is intended that the following claims cover all possible example embodiments.

The invention claimed is:

1. A controller for a lamp, comprising an input terminal configured to receive a requested-colour-signal representative of a requested-colour-value to be provided by the lamp; and one or more temperature-values associated with the lamp;

an output terminal configured to provide a lamp-control-signal to the lamp;

a full-colour-module configured to provide a full-colour-lamp-control-signal for the output terminal;

a stabilization-module configured to provide a stabilized-lamp-control-signal for the output terminal; and a mode controller configured to compare the requested-colour-value with a threshold value, and if the requested-colour-value satisfies the threshold value, then instruct the stabilization-module to provide the stabilized-lamp-control-signal to the output terminal;

if the requested-colour-value does not satisfy the threshold value, then instruct the full-colour-module to provide the full-colour-lamp-control-signal to the output terminal;

wherein the stabilization-module is configured to generate stabilized-colour-values based on the temperature-values; and provide the stabilized-lamp-control-signal based on the requested-colour-value and the stabilized-colour-values; and wherein the full-colour-module is configured to provide the full-colour-lamp-control-signal based on the requested-colour-value.

2. The controller of claim 1, wherein the stabilized-lamp-control-signal represents an equally or less saturated colour than the full-colour-lamp-control-signal.

3. The controller of claim 1, wherein the stabilization-module is configured to add one or more colour-correction-values to colour-values that define a full-colour-gamut in order to generate the stabilized-colour-values, the full-colour-lamp-control-signal represents a colour-value in the full-colour-gamut; and the stabilized-lamp-control-signal represents a colour-value in a stabilized-colour-gamut, as defined by the stabilized-colour-values.

4. The controller of claim 1, configured to receive information representative of a requestable-colour-gamut for the lamp, and wherein the threshold value corresponds to a boundary of the requestable-colour-gamut.

5. The controller of claim 1, wherein the lamp comprises first, second and third colour LEDs, the stabilized-colour-values comprise RGB values, and wherein the stabilized-lamp-control-signal is representative of a colour-value that is within a colour gamut defined by the stabilized-colour-values.

6. The controller of claim 1, wherein the stabilized-lamp-control-signal represents a colour within a stabilized-colour-gamut of the lamp having stabilized-chromaticity-limits, and the full-colour-lamp-control-signal represents a colour within a full-colour-gamut of the lamp having full-colour-chromaticity-limits, and wherein the stabilized-colour-gamut is a subset of the full-colour-gamut.

7. The controller of claim 1, wherein the lamp comprises first, second and third colour LEDs, and wherein the threshold value represents a light output of the lamp provided in accordance with the stabilized-lamp-control-signal for which one of the LEDs has a light output below a LED-threshold-value.

8. The controller of claim 1, wherein the stabilization-module is further configured to generate the stabilized-colour-values based on the temperature-value, and a difference-value representative of the distance between (i) the requested-colour-value; and (ii) a boundary of a requestable-colour-gamut.

9. The controller of claim 8, wherein the stabilization-module is configured to set a degree of stabilization that is applied to the requested-colour-value based on the difference-value.

10. The controller of claim 1, wherein the controller is configured to linearly combine the full-colour-lamp-control-signal and the stabilized-lamp-control-signal in order to provide the lamp-control-signal.

11. The controller of claim 10, wherein the coefficients of the linear combination are functions of a difference-value representative of the distance between (i) the requested-colour-value; and (ii) a boundary of a requestable colour gamut.

12. The controller of claim 1, wherein the full-colour-module is configured to provide the full-colour-lamp-control-signal based on the temperature-values.

13. The controller of claim 1, wherein the threshold value is 1%, 2%, or 5% of a maximum colour value.

14. The controller of claim 1, wherein the lamp comprises a white LED.

15. A method of controlling a lamp, the method comprising receiving a requested-colour-signal representative of a requested-colour-value to be provided by the lamp;

receiving one or more temperature-values associated with the lamp;

comparing the requested-colour-value with a threshold value;

if the requested-colour-value satisfies the threshold value, then generating stabilized-colour-values based on the temperature-values; and providing a stabilized-lamp-control-signal based on the requested-colour-value and the stabilized-colour-values;

if the requested-colour-value does not satisfy the threshold value, then providing a full-colour-lamp-control-signal based on the requested-colour-value; and providing a lamp-control-signal to the lamp based on the stabilized-lamp-control-signal or the full-colour-lamp-control-signal.

* * * * *